US006802271B2

(12) United States Patent
Oxley et al.

(10) Patent No.: US 6,802,271 B2
(45) Date of Patent: Oct. 12, 2004

(54) AUTOMATIC BORDER SEWING SYSTEM

(75) Inventors: Warren Oxley, Auburn, GA (US); Preston B. Dasher, Lawrenceville, GA (US); John S. Chamlee, Lawenceville, GA (US); Van H. Nguyen, Lawrenceville, GA (US); Danny V. Murphy, Dacula, GA (US); George A. Price, Lawrenceville, GA (US); Stephen S. Ruderman, Lilburn, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 101 days.

(21) Appl. No.: 10/339,252

(22) Filed: Jan. 8, 2003

(65) Prior Publication Data

US 2004/0129189 A1 Jul. 8, 2004

(51) Int. Cl.[7] ..... D05B 11/00

(52) U.S. Cl. ..... 112/2.1; 112/475.08

(58) Field of Search ..... 112/2.1, 470.07, 112/470.33, 152, 130, 153, 304, 306, 307, 475.06, 475.08; 83/208, 209, 901, 902, 910, 923, 937, 939; 5/703, 495, 499

(56) References Cited

U.S. PATENT DOCUMENTS

| | | | | | |
|---|---|---|---|---|---|
| 1,947,058 | A | | 2/1934 | Pittoni | 112/33 |
| 3,013,513 | A | | 12/1961 | Judelson | 112/203 |
| 3,673,906 | A | | 7/1972 | Cash | 83/208 |
| 4,141,304 | A | | 2/1979 | Masuda | 112/153 |
| 4,462,129 | A | | 7/1984 | Brannock | 5/474 |
| 4,616,584 | A | * | 10/1986 | Vartoukian et al. | 112/470.16 |
| 4,773,341 | A | * | 9/1988 | Brocklehurst | 112/470.16 |
| 4,825,787 | A | | 5/1989 | Babson et al. | 112/262.3 |
| 4,827,856 | A | | 5/1989 | Rohr | 112/63 |
| 4,838,186 | A | | 6/1989 | Resta et al. | 112/2.1 |
| 5,018,462 | A | | 5/1991 | Brocklehurst | 112/121.12 |
| 5,185,897 | A | | 2/1993 | Van Laanen | 5/455 |
| 5,282,433 | A | | 2/1994 | Freermann et al. | 112/153 |
| 5,529,004 | A | | 6/1996 | Porter et al. | 112/470.03 |
| 5,537,699 | A | | 7/1996 | Bonaddio et al. | 5/474 |
| 5,560,308 | A | | 10/1996 | Eto | 112/740.07 |
| 5,617,802 | A | | 4/1997 | Cash | 112/117 |
| 5,664,508 | A | * | 9/1997 | Mulcahey et al. | 112/2.1 |
| 5,724,686 | A | | 3/1998 | Neal | 5/717 |
| 5,881,656 | A | | 3/1999 | Grant | 112/2.1 |
| 5,915,319 | A | | 6/1999 | Price et al. | 112/470.16 |
| 6,000,352 | A | | 12/1999 | Porter et al. | 112/470.12 |
| 6,055,921 | A | | 5/2000 | Olewicz et al. | 112/475.07 |
| 6,202,579 | B1 | | 3/2001 | Olewicz et al. | 112/2.1 |
| 6,209,468 | B1 | | 4/2001 | Marcangelo et al. | 112/475.06 |
| 6,293,213 | B1 | * | 9/2001 | Block et al. | 112/470.05 |
| 6,397,768 | B1 | | 6/2002 | Dasher et al. | 112/2.11 |
| 6,408,773 | B2 | * | 6/2002 | Resta | 112/2.1 |
| 2002/0050117 | A1 | | 5/2002 | Dasher et al. | 53/117 |

FOREIGN PATENT DOCUMENTS

| | | | |
|---|---|---|---|
| EP | 0 264 618 | 4/1988 | D05B/11/00 |

* cited by examiner

*Primary Examiner*—Ismael Izaguirre
(74) *Attorney, Agent, or Firm*—Womble Carlyle Sandridge & Rice, PLLC

(57) ABSTRACT

An automatic border sewing system having a pre-feed assembly for feeding a length of material for forming a mattress border. A feed and cut assembly feeds the border material into a sewing station for forming mitered corners in the border material and thereafter cuts the border material to form a border of a desired length. The mitered border is moved to a closer station for closing the leading and trailing edges of the border.

32 Claims, 6 Drawing Sheets

AUTOMATIC BORDER SEWING SYSTEM

FIELD OF THE INVENTION

The present invention relates to sewing equipment, and in particular, to an automated assembly or system for measuring and sewing a mattress border with mitered corners and thereafter automatically closing the border to form a finished work piece.

BACKGROUND OF THE INVENTION

In the textile field, most sewing operations traditionally have been extremely labor intensive, manual operations that further generally have required a significant amount of skill on the part of the sewing operator to cut, sew, and finish textile articles. The more labor intensive and the greater the amount of skill required of the operator to form a textile article, however, the greater the cost and the more limited or slower the production of such articles. As a result, there have been efforts to develop more automated sewing equipment that will enable less skilled operators to operate the equipment and form a textile article, or which can be operated with less operator control or intervention required, such that one operator can run multiple sewing stations at one time in order to increase production while decreasing the manpower and skill level of the operator required to form the desired textile articles.

For example, automated systems have been developed for sewing various components or pieces of mattresses, such as sewing pillow tops or borders for mattresses. Currently, there exist automated systems that enable a worker to measure, cut and sew a border for a mattress. A significant drawback of such automated equipment is, however, that it is limited in the type and number of sewing operations that can be performed to manufacture a mattress foundation border. Recently, it has become more desirable to fashion mattress borders with mitered corners to form a "Continental Foundation Border" wherein a portion of the border can be folded over and laid flat on the top of the mattress with its corners mitered and sewn so as to form a flat, finished even appearance with the mattress top. Conventional automated border sewing workstations generally have not been designed to form such mitered corners, and therefore, after a plain foundation border has been formed, an operator typically must manually cut and sew mitered corners in the finished border in order to form a continental foundation border, creating additional labor and expense in the manufacture of such continental foundation borders.

It accordingly can be seen that a need exists for addressing the foregoing and other related problems in the art.

SUMMARY OF THE INVENTION

Briefly described, the present invention relates to an automatic border sewing assembly or system that is generally designed to form foundation borders for mattresses, and which is programmable to form borders of different sizes and configurations for different mattresses, including the formation of "Continental" style foundation borders, and which further can be programmed to apply labeling to the finished borders. The automatic border sewing system generally includes a programmable control system with an operator interface or input device through which an operator can program different features or styles of mattress borders to be formed and which accordingly monitors the operation of the various components of the sewing system. The automatic border sewing system further includes a series of operative assemblies or components, including a pre-feed assembly, a feed and cut assembly, and a closer station. The various operative assemblies or components of the automatic border sewing system can be designed as separate modules that can be linked together, or can be mounted on a single frame as part of a unitary assembly.

The pre-feed assembly generally includes a support for holding a supply reel of a textile border material and a feed system that includes feed rolls for engaging and pulling a desired length of border material from the supply roll. Fault and end or edge detectors are mounted at an upstream end of the pre-feed assembly adjacent the supply roll. The fault detector detects flaws or blemishes in the border material, while the end or edge detector detects the absence of border material, indicating that the end of the border material has been reached, and signals the system control to halt the operation of the automatic border sewing system for replacement of the empty supply roll. A splice detector is positioned immediately upstream from the drive rolls. As a splice between the trailing end of a first roll of border material and the first or leading end of new roll of material passes under a roller of the splice detector, the roller is pivoted or moved upwardly, causing a signal to be sent to the system control to indicate that a splice has been detected, which can later be automatically removed by the sewing system.

The border material is fed from the pre-feed assembly into the feed and cut assembly, with a slack portion or desired amount of excess border material being provided between the pre-feed and the feed and cut assemblies to ensure there is a sufficient amount of border material for forming a completed border. The feed and cut assembly includes a primary clamp that engages and holds the border material, a cutting blade for separating a border from the length of supply of border material, and pairs of upper and lower feed rolls driven at varying rates for engaging and pulling the border material through the feed and cut assembly. A sewing station is positioned adjacent the feed rolls and includes a sewing table on which a portion of the border material is received, and a sewing head that engages, cuts and sews mitered corners in the border material. Upon detection of a mitering or corner location approaching the sewing station for a mitering or sewing operation, forward movement of the border material is halted and the operation of the lower drive rolls is reversed so as to feed a section or portion of border material between the upper and lower drive rolls laterally onto the sewing table for engagement and sewing by the sewing head. This process generally is repeated until all four mitered corners are sewn in the border. Thereafter, the cutting blade separates the mitered border from the supply of border material.

After the mitered border is separated, a secondary clamp engages the border adjacent its transports the border to the closer station. The closer station includes a sewing head and first and second detectors that monitor and control the sewing and closing of the ends of the border to form the completed border. A labeler further generally is positioned adjacent the closer station, with the system being programmable to move the finished border into the labeler for application of a label thereto. Once the ends of the border have been closed and, if desired, a label has been applied to the border, the arms of the secondary clamp are separated and an unloader plate pushes the border away from the secondary clamp.

Various objects, features and advantages of the present invention will become apparent to those skilled in the art upon consideration of the following description when taken in conjunction with the accompanying drawings.

DETAILED DESCRIPTION OF THE INVENTION

Figure 1:
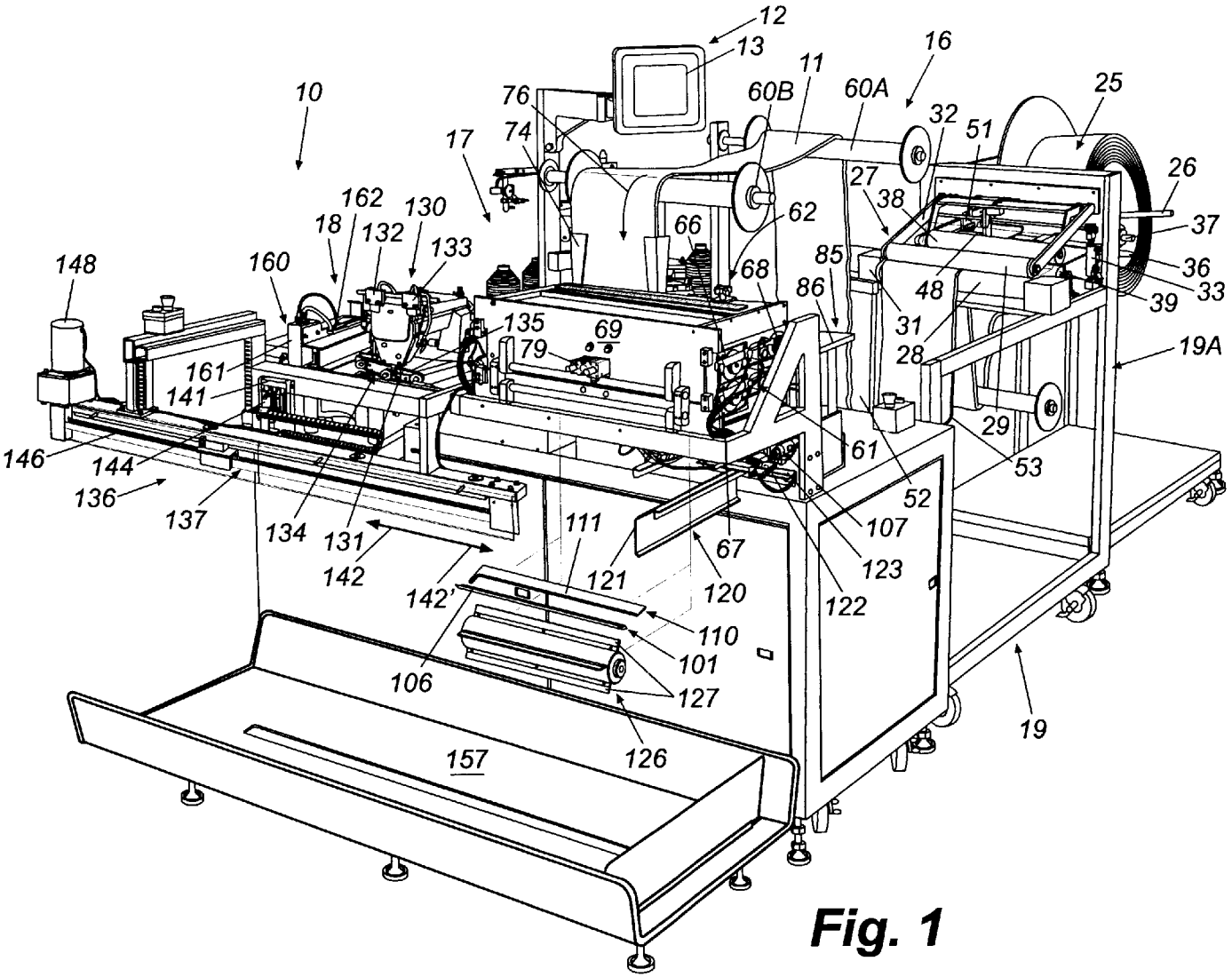
FIG. 1 is a perspective view of the automatic border sewing system of the present invention.
Figure 2:
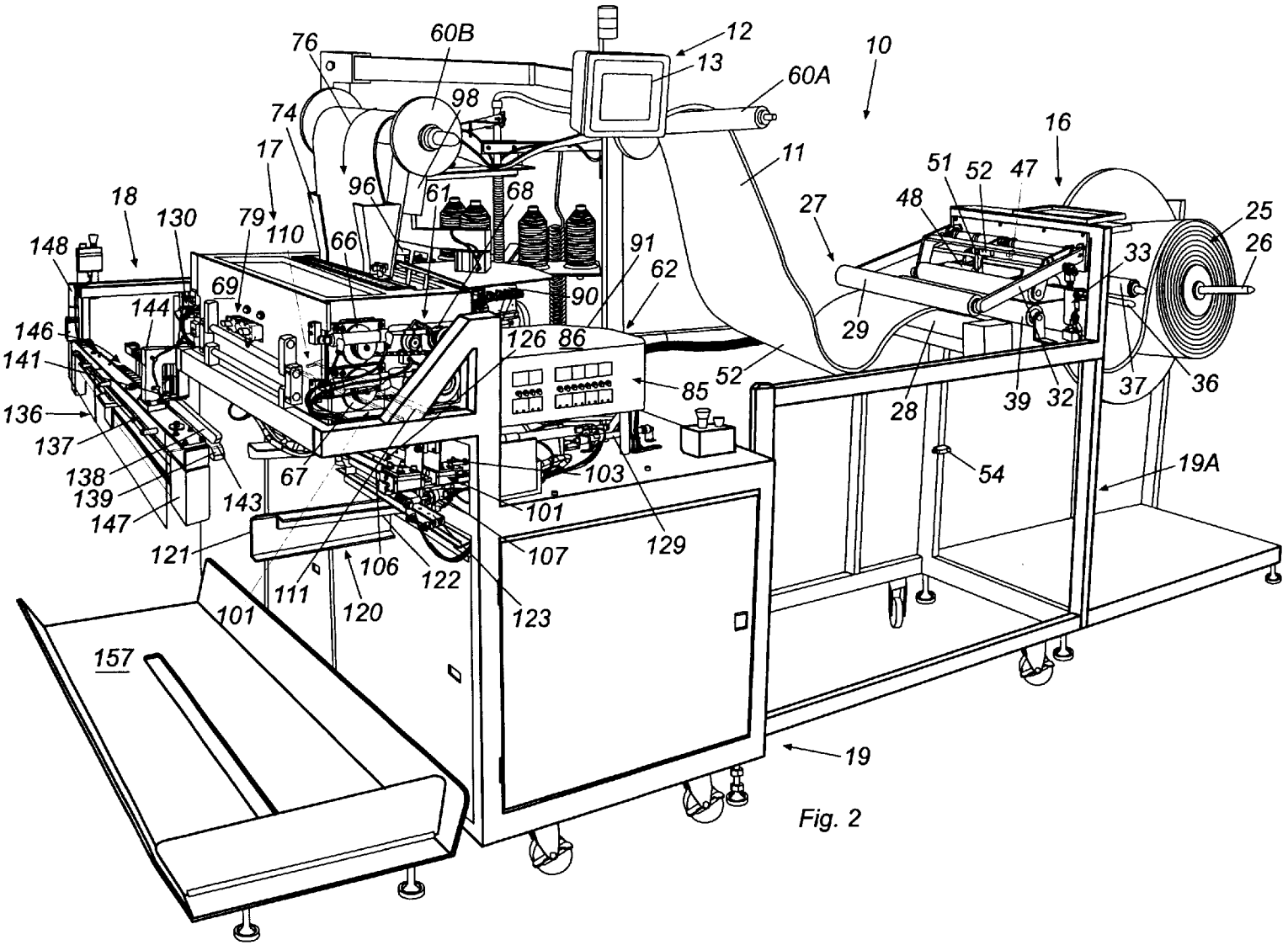
FIG. 2 is a perspective view of the automatic border sewing system of FIG. 1, illustrating further the pre-feed and feed and cut assemblies.

Referring now in greater detail to the drawings in which like numerals indicate like parts throughout the several views, FIGS. 1 and 2 generally illustrate the automatic border sewing system 10 of the present invention. The automatic border sewing system 10 generally is designed to automatically measure a length of a fabric or textile material 11, typically a foundation border material for a mattress, cut and sew mitered corners in the length of border material 11, and thereafter cut and close the leading and trailing material ends of the border material to form a finished plain or mitered, "Continental," style foundation border for a mattress. The automatic border sewing system further can be programmed to apply labeling or other graphics or markings, such as to indicate handle positions for the mattress, at a desired location along the mattress border.

The automated border sewing system 10 generally includes a programmable control system 12 having a control processor (not shown) and an operator interface 13, such as touch screen monitor, key pad or other input system or device that enables the control system 12 to be programmed to run various sizes and types of borders, including forming "Continental" style or plain foundation mattress borders in twin, double, queen, king or various other mattress sizes. The operator interface 13 provides feedback and displays indications or warnings to an operator. The control system 12 further can comprise a serial bus control system such as embodied in U.S. Pat. No. 6,295,487, the disclosure of which is incorporated by reference. The control system generally monitors and controls the operation of various operative assemblies or components of the automated border sewing system 10, including a pre-feed assembly 16, cut and feed assembly 17, and a closer station or assembly 18. Such operative assemblies can be constructed as individual or separate modules that can be linked or otherwise connected together in series, or which can be included or mounted together on a unitary system framework 19.

Figure 3:
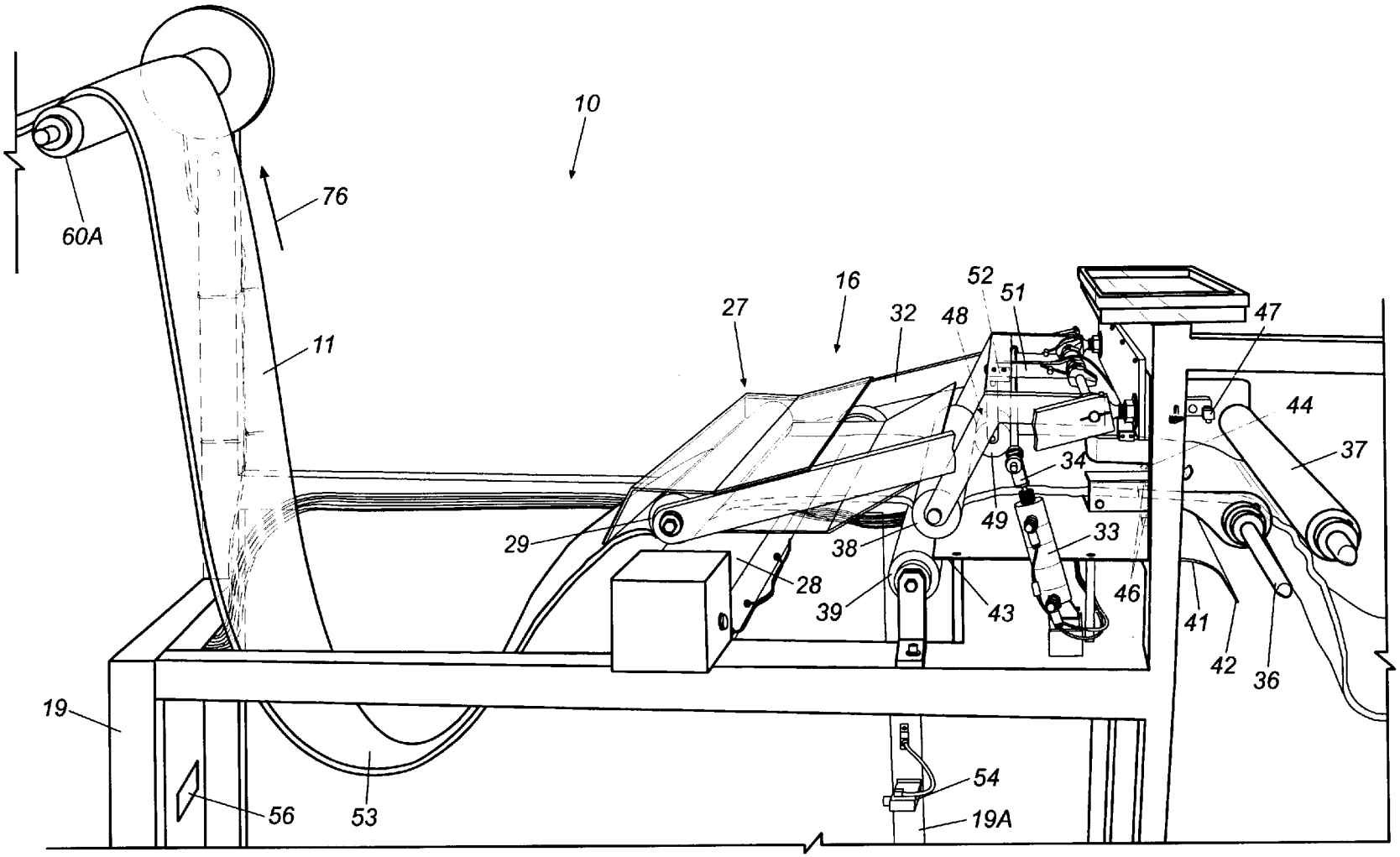
FIG. 3 is a side elevational view of the pre-feed assembly of the present invention.

As generally illustrated in FIGS. 1–3, the pre-feed assembly 16 is designed to engage and pull a measured or desired length of border material 11 from a supply roll 25 that is generally rotatably received on holder or spindle 26 at the upstream end of the pre-feed assembly, for cutting and sewing by the cut and feed assembly 17 (FIGS. 1 and 2) to form a border. The measured amount of border material 11 that is pre-fed by the pre-feed assembly 16 generally is determined by an amount or length of border material that is required for forming a specific size or length of a finished border, i.e. for a twin, double, queen, king, etc. mattress.

As indicated in FIG. 3, the pre-feed assembly 16 generally includes a module or assembly frame 19A, with a feed system or assembly 27 positioned at the downstream end of the pre-feed assembly. The feed system 27 generally includes a pair of feed rolls 28 and 29, with the lower feed roll 28 being a driven roll that is driven by a variable speed drive motor 31 (FIG. 1). The upper feed roller 29 generally is an idler roller rotatably mounted on a pair of support arms 32 that are further pivotally attached to the module frame 19A so as to enable the pivoting movement of feed roll 29 as the border material is pulled thereunder. A pneumatic cylinder 33 is mounted to the module frame 19A and includes a cylinder rod 34 connected to one of the support arms 32 for feed roll 29. The cylinder 33 tends to pull downwardly on arm 32 so as to maintain the idler feed roll 29 in bearing contact with the driven feed roll 28 so that the border material is engaged and pulled between the feed rolls 28 and 29 as the feed rolls are rotated.

As further illustrated in FIG. 3, the border material 11 is passed about or between a series of guides or supports 36–39, which help guide and maintain the border material in a substantially flat attitude as it is fed between the feed rolls 28 and 29. Such guides or supports generally include an upstream support rod 36, and guide rollers 37–39. A guide plate 41 is mounted between an upstream guide roll and support rod 36, 37 and downstream guide rolls 38 and 39, over which the fabric border material is fed. The guide plate 41 generally is a substantially flat plate, typically formed from a polished metal, synthetic or similar material, with a smooth upper surface so as to minimize drag on the border material, and includes a downwardly sloping upstream or first end 42, a downstream or second end 43, and an aperture or detector opening 44 that is formed through the plate adjacent its upstream or first end 42. A fault detector, shown in dashed lines 46, typically a photoelectric or photosensitive eye or similar type of detector, is mounted beneath the guide plate 41 in a position to monitor the fabric border material 11 through the detector opening 44. The fault detector generally can be set for various sensitivities or levels of light shining through the border material, depending on the thickness and type of border material used, in order to detect flaws or faults or markings made on the fabric border material, such as for the placement of handles on the border material, and will signal the detection of such faults or markings to the control system 12 (FIGS. 1 and 2) to indicate the position or location of such faults along the length of border material.

An end or edge detector 47 (FIG. 3) generally is mounted above the guide plate 41 and support rod 36 adjacent the upstream end of the pre-feed assembly 16, in a position to detect a trailing or second end of the border material 11 passing through the pre-feed assembly, which is indicative of the exhaustion of the supply of border material on the supply roll 25. The end detector generally is a photoelectric eye or similar sensor or detector that detects a piece of reflective tape (not shown) applied along the support rod 36 as the end of the border material passes thereover, and accordingly sends a signal to the control system of the automatic border sewing system so as to indicate that the supply of border material has been exhausted. In response, the control system generally will automatically shut down the automatic border sewing system and can provide an alert to an operator so that an additional or new supply of border material can be placed on the holder or spindle 26 (FIG. 1) and its leading or first end spliced to the end of the previous supply of border material, after which the system can be restarted for continued operation.

As shown in FIG. 3, a splice detector 48 further is generally positioned immediately upstream from the feed rolls 28 and 29. The splice detector 48 generally includes a roller, shown in dashed lines 49, mounted on an arm or similar support 51 and which rolls along the upper surface of the border material as the border material is fed through the pre-feed assembly. As the roller 49 of the splice detector 48 rolls over a splice between the ends of the border material, the roller 49 and arm 51 are urged or moved upwardly, which movement is detected by a proximity sensor 52, or which can cause the engagement or actuation of a switch, which in turn causes a signal to be sent to the control system indicating that a splice has been detected. Upon receipt of this splice signal, the location of the splice is noted by the system control, since it is aware of the distance or length of material between the splice detector and the feed and cut assembly, so that the splice can be automatically removed by the automatic border sewing system upon completion of the current sewing cycle.

As further illustrated in FIG. 3, the pre-feed assembly generally pulls or feeds a measured amount of excess or slack 53 of border material 11 from the supply 25 so as to ensure a sufficient amount of border material will be provided for forming a finished border of a desired size or length. The slack portion 53 of the border material 11 is allowed to drape between the downstream end of the pre-feed assembly 16 and an upstream end of the feed and cut assembly 17, as indicated in FIGS. 1 and 3. A slack detector 54 (FIG. 3) further is mounted along a section or portion of the module frame 19A of the pre-feed assembly 16 in a position to detect the covering/uncovering of a piece of reflective tape 56 applied to a cabinet or other section of system framework 19, opposite the slack detector 54. The slack portion 53 of the border material 11 is fed by the pre-feed assembly 16 until the reflective tape 56 is covered by the slack portion, whereupon the slack detector 54 sends a signal to the control system to stop further operation of the pre-feed assembly 16 as the mitering and sewing operation is begun.

Figure 4A:
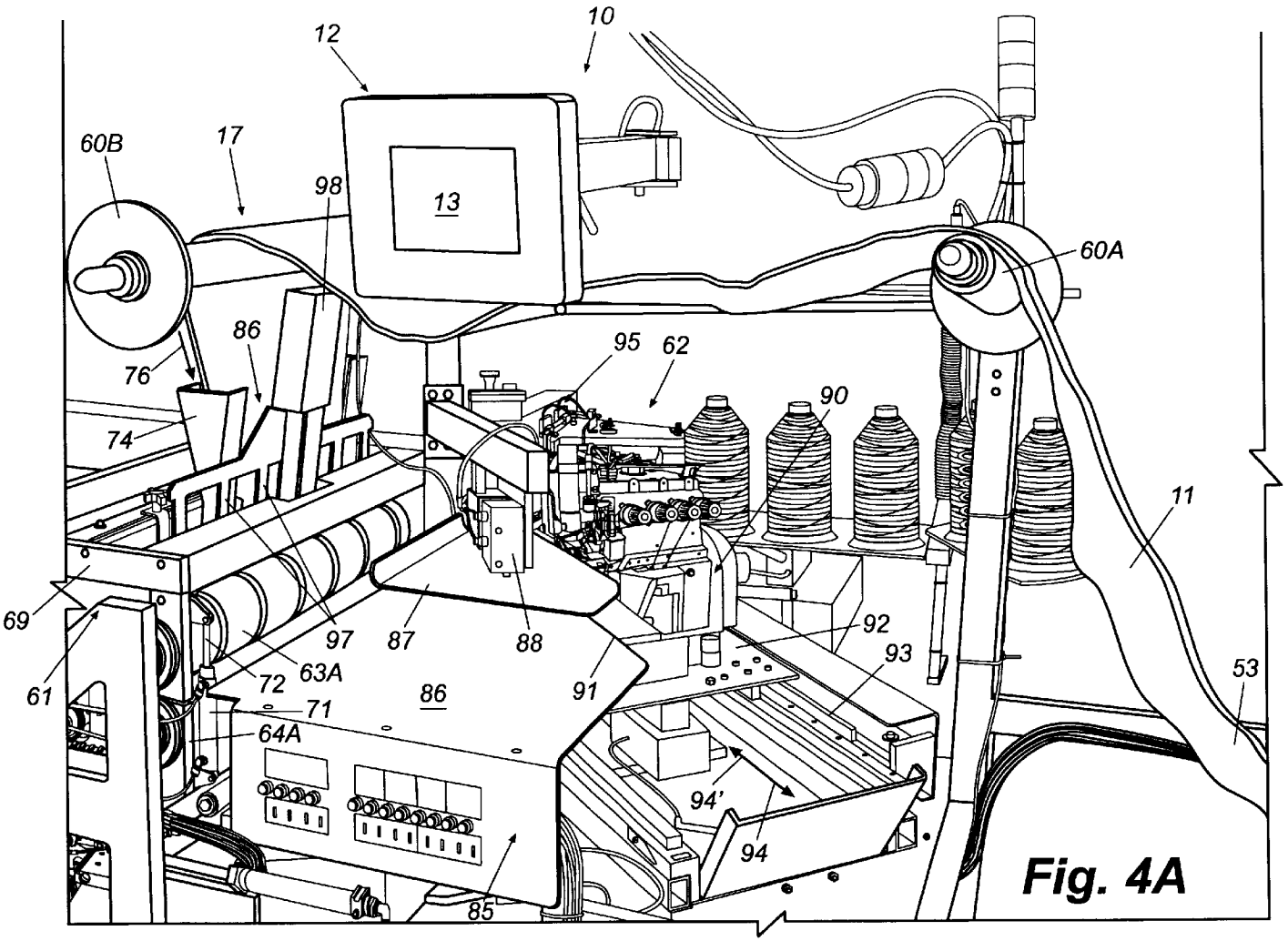
FIGS. 4A and 4B are perspective views of the feed and cut assembly, illustrating the sewing station and drive assembly of the feed and cut assembly.
Figure 4B:
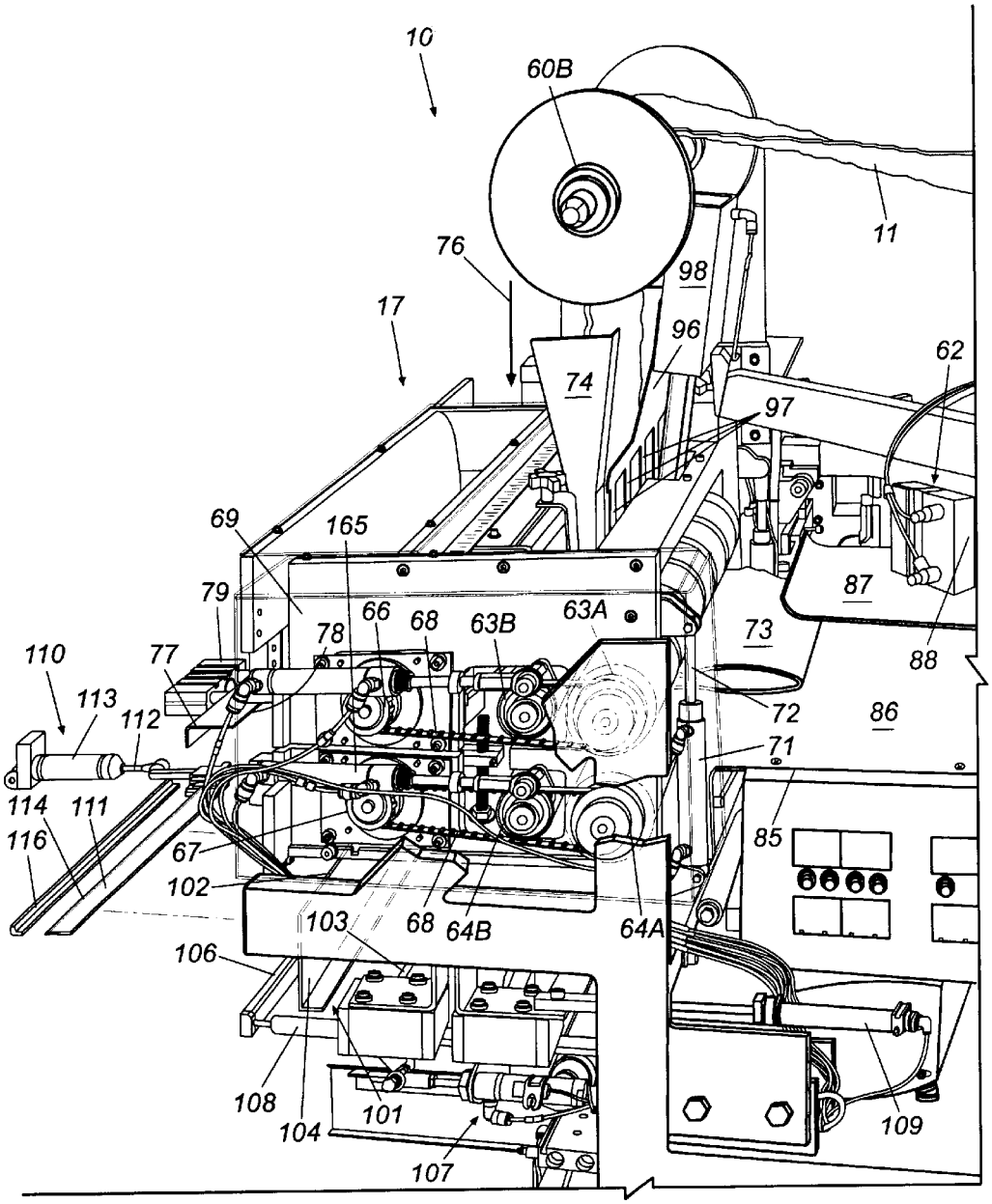

As illustrated in FIGS. 2 and 4A–4B, the feed and cut assembly 17 of the automatic border sewing system 10 is positioned downstream from the pre-feed assembly and generally includes a pair of upper border supports or guide rolls 60A and 60B, over which the border material 11 is passed or guided for feeding to a drive roll assembly 61 and sewing station 62. As indicated in FIGS. 2 and 4B, the drive roll assembly 61 generally includes a first or upper pair of drive rolls 63A, 63B and a lower or second pair of drive rolls 64A, 64B. At least one drive roll 63A, 64A, of each of the pairs of drive rolls is rotated independently by a separate drive motor 66 and 67, respectively, as indicated in FIG. 2. Each of the drive motors 66 and 67 (FIGS. 4B) generally is an electric, variable speed reversible drive motor, connected to one of the drive rolls 63A/64A, respectively, each pair of upper and lower drive rolls being driven by a drive belt or chain, as indicated at 68, while the other drive rolls 63B and 64B can be idler rolls or can be also driven by the drive motors and drive belts.

The pairs of drive rolls 63A/B and 64A/B, further are generally mounted within a pivoting cabinet or housing 69, with the upper pair of drive rolls 63A/B generally being pivotable toward and away from the lower pair of drive rolls 64A/B with the pivoting movement of the housing 69 so as to create a gap or space between upper and lower drive rolls 63A and 64A. A lift cylinder 71 (FIGS. 4A and 4B) is mounted along the front or upstream side of the housing 69 and includes a cylinder rod 72 attached to the housing. The lift cylinder is engaged by the control system so as to lift the housing as needed or desired to create the desired separation or gap between upper and lower drive rolls 63A and 64A to enable a mitering or corner portion 73 (FIG. 4B) of the border material 11 to be fed therebetween. The drive roll assembly 61 further includes an encoder (not shown) mounted on at least one of the drive rolls 63A/B and/or 64 A/B. The encoder monitors the revolution of its drive roller and provides a count or indication of the amount of border material fed between the drive rolls 63A/B and 64A/B to enable the control system 12 (FIG. 1) to monitor and accurately detect how much border material has been fed through the feed and cut assembly 17 for calculating corner spacing or length for forming the border and mitering or corner locations, and for controlling when and how much border material is fed into the sewing station 62 for forming the mitered corners in a border of the desired or pre-set size.

Additionally, as shown in FIGS. 1, 2 and 4A, a border guide 74 is mounted along the top of the housing 69, adjacent the gap between the upper drive rolls 63A and 63B. The border guide is a substantially U-shaped plate that receives and directs the border material 11 downwardly between the pairs of drive rolls for feeding along a forward path of travel indicated by arrow 76. As further indicated in FIG. 4B, a folding plate 77 is positioned between the upper and lower pairs of drive rolls 63A/B and 64A/B. The folding plate 77 generally is a substantially flat plate or blade having a forward folding edge 78. The folding plate is attached to a folding plate cylinder 79, controlled by the control system of the automatic border sewing system for moving the folding plate laterally into and out of engagement with the border material passing between the pairs of drive rolls. The folding plate 77 typically is moved forwardly during a corner mitering and sewing operation to help urge the corner portion 73 of the border material 11 between upper and lower drive rolls 63A and 64A, while at the same time the operation of the lower pair of drive rolls 64A/B is reversed so as to cause the corner portion 73 to be directed and fed between drive rolls 63A and 64A toward the sewing station 62.

As FIGS. 4A and 4B illustrate, the sewing station 62 generally includes a sewing table 85 having a flat, substantially smooth upper surface 86 over which the corner portion of the border material is received for cutting and sewing. A clamp plate 87 is mounted above the upper surface 86 of the sewing table 85 and is moveable vertically toward and away from the upper surface of the sewing table by operation of a pneumatic cylinder 88. The cylinder 88 is engaged and disengaged by the control system 12 upon the feeding of a sufficient miter fold distance or length of the corner portion of the border material onto the sewing table as monitored and detected by the control system. Upon detection of the movement of the border material a desired miter fold distance, the system control engages the clamp plate cylinder 88 to lower the clamp plate 87 into engagement with the corner portion of the border material on the upper surface of the sewing table to clamp and hold the border material in place for mitering/sewing.

As further illustrated in FIGS. 2 and 4A, the sewing station 62 also includes a sewing head 90, positioned along an angled, outer-side edge 91 of the sewing table 85. The sewing head generally is an overlock stitch type sewing machine or sewing head, such as a Yamato Safety Stitch AZF—8600 sewing head, or can be any other similar overlock stitch type sewing machine as will be understood by those skilled in the art. The sewing head 90 generally is mounted on a carriage 92 that is moveable along a pair of guide tracks 93 in the direction of arrows 94 and 94' so as to engage, cut and sew a mitered corner in the corner portion of the border material and clamped on the sewing table 85. The carriage, with the sewing head 90 thereon, generally will be moved along its guide tracks 93 by operation of a drive motor or hydraulic cylinder (not shown) although other, alternative drive mechanisms can also be utilized for moving the sewing head along its sewing path indicated by arrows 94 and 94'. In addition, the area of beneath the carriage 92 and between the guide tracks 93 generally is open to enable the portion of the border material cut away during the mitering and sewing of the corner to drop therethrough for disposal.

A sewing detector 95 (FIG. 4A) generally is mounted adjacent the sewing head 90, directed slightly upstream from the presser foot and needle of the sewing head 90. The sewing detector 95 generally is a photoelectric eye or similar sensor or detector, which detects the presence of the border material upon feeding of the desired miter fold distance thereof, and accordingly engages the sewing head to begin a sewing operation. Once the sewing detector 95 detects that the far edge of the corner portion of the border material has been reached, it signals the system control, which allows the sewing cycle to be operated for a stop delay, wherein a preset or predetermined further amount of stitches is sewn, so that the sewing head sews off the outer corner of the border material, after which the thread chain is cut to complete the sewing operation. Thereafter, the corner portion can be retracted between the drive rolls for further forward feeding of the border material until a next corner or miter location in the border material is reached.

As further shown in FIGS. 4A and 4B, a tucking plate 96 is mounted above the upper pair of drive rolls 63A/B, adjacent the gap between the drive rolls, where the border material 11 passes between the upper and lower pairs of drive rolls. The tucking plate 96 generally is an elongated metal or plastic plate having a series of fingers or tines 97 that project downwardly between the upper drive rolls 63A/63B. A tucking plate cylinder 98 is mounted above the tucking plate and moves the tucking plate downwardly into engagement with the border material following the completion of the corner sewing operation so as to urge the border material back between the drive rolls 63A/B and 64A/B. As the drive rolls are then engaged, they will pull the corner portion away from the sewing station and continue the feeding of the border material along its forward path of movement of continued feeding of the border material.

As further indicated in FIG. 4B, the feed and cut assembly 17 also includes a primary clamp assembly 101 mounted below the lower pair of drive rolls 64A and 64B. The primary clamp assembly 101 generally includes a vertically extending bearing or clamp plate 102 that acts as a guide and bearing surface against which the border material is engaged and held during cutting. The primary clamp assembly further includes a first or inside clamp bar 103 adapted to engage the border material adjacent an initial or leading cut end thereof and holds the border material against a side surface 104 of the bearing plate 102, and a second or outside clamp bar 106 that can be moved independently of the first or inside clamp bar and which engages the border material adjacent a point along which a trailing or second cut edge will be formed in the border material. The inside and outside clamp bars 103 and 106 are mounted to and moved between rest, non-engaging positions and forward, engaging positions to clamp the border material against plate 102 by cylinders 107 and 108, which are controlled and selectively activated by the control system of the automatic border sewing system. The primary clamp assembly 101 itself is moved from an inward position to an outer position by the operation of a drive cylinder 109 (FIG. 4B).

The feed and cut assembly 17 of the automated border sewing system 10 further includes a cutting assembly including a cutting blade 111 is positioned above the primary clamp assembly 101. The cutting blade 111 is moveable between a non-engaging rest position and a forward, engaging position in which the cutting blade will engage and cut the border material to separate a mitered border. The cutting blade generally is an elongated knife blade attached to a cylinder rod 112 of a cutting blade cylinder 113. The cylinder 113 is actuated by the control system of the automated border sewing station upon a feeding of a sufficient amount of border material to form a completed border. Upon actuation, the cutting blade 111 is moved laterally across the path of travel of the border material toward its engaging or cutting position. The cutting edge 114 of the cutting blade will engage the border material against a cutting block 116 so as to sever and separate the border from the supply of border material in a guillotine type cutting operation so as to substantially cleanly and completely sever or cut the trailing edge of a sewn, mitered border from the remaining supply or length of border material.

As further illustrated in FIGS. 1 and 2, a side guide plate 120 is moveable laterally across the forward path of travel or movement of the border material into engagement with one side edge of the border material as the mitered corners are being sewn therein. The guide plate 120 generally is a substantially flat, rectangularly shaped plate, although other configurations also can be used, and has a substantially smooth front surface 121 along which the side edge of the border material is engaged and will slide as the border material is fed through the feed and cut assembly. The guide plate 120 is mounted to a support bar 122, which is attached to a cylinder 123 for movement of the guide plate 120 toward and away from the side edge of the border material. During a sewing/mitering operation, as the border material is cut and sewn to form the mitered corners therein, the border material will tend feed unevenly since a portion of the border material along the edges where the corners are formed has been cut and sewn to form the mitered corners. By engaging the side edge of the border material as it is passed below the drive rolls, the border material can be maintained in a substantially even, consistent alignment so that its leading and trailing edges will be substantially aligned for cutting and transport to the downstream closer station 18.

As additionally shown in FIG. 1, a border support roller 126 is positioned below the feed an cut assembly 17 and is moveable between a retracted, non-engaging position and an extended, engaging position for engaging and supporting the border material as it is fed through the feed and cut assembly during the mitering/sewing operation. The border support roller 126 generally includes a series of fins or paddles 127 that engage the border material as it is fed through the feed and cut assembly so as to prevent bunching or tangling of the border material, and is rotatably mounted on a carriage or support (not shown) for movement between its engaging and non-engaging positions. The border support roller 126 generally is driven by a variable speed drive motor (not shown) that causes the border support roller to be rotated. A cylinder assembly 129 (FIG. 2) supports and moves the border support roller 126 between its retracted, non-engaging position and its extended, engaging position engaging the border material so that its fins engage and bear against the border material to assist in the feeding of the border material through the feed and cut assembly.

Figure 5:
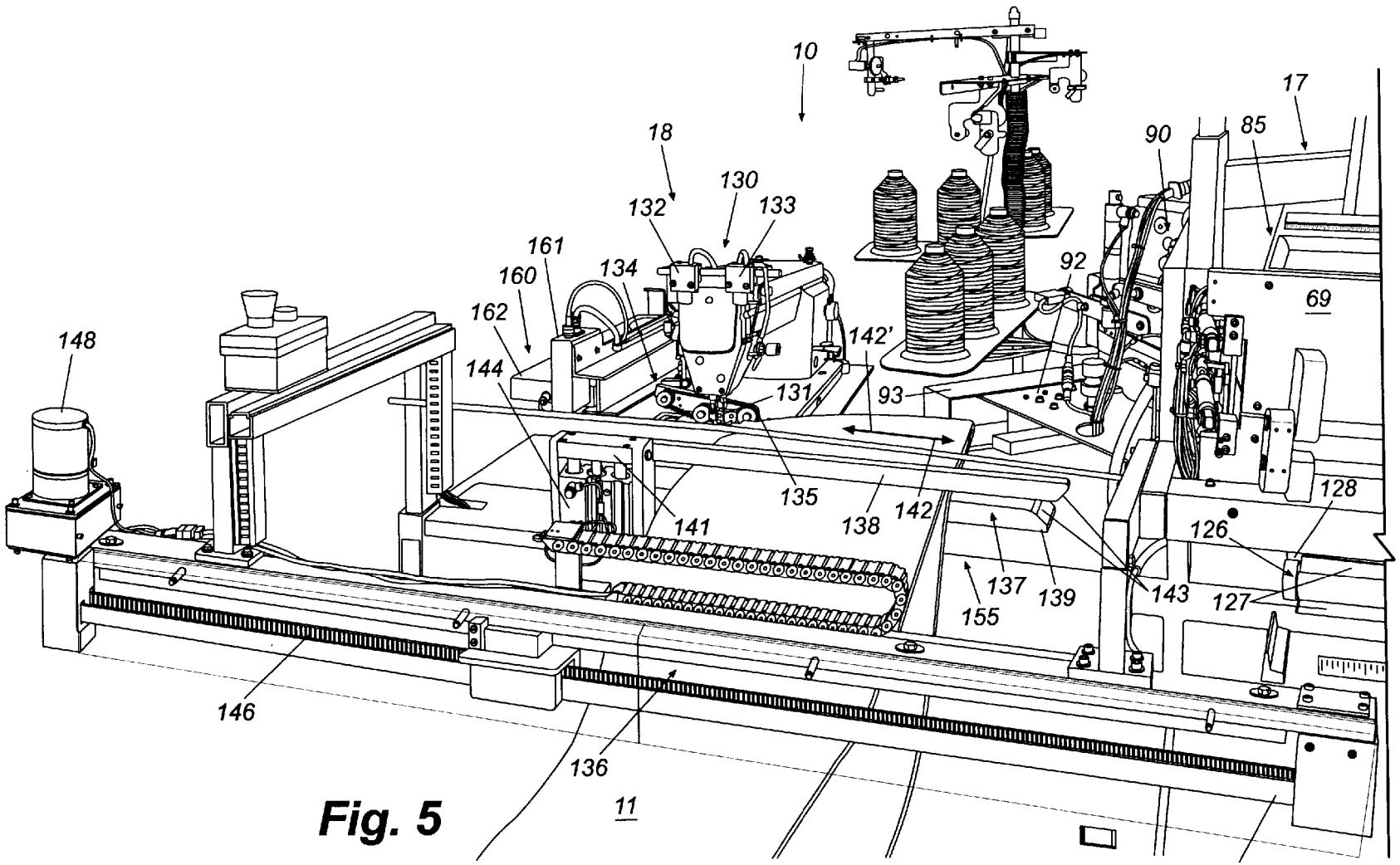
FIG. 5 is a perspective view of the closer station, illustrating the engagement and closing of the ends of a foundation border.

As shown in FIGS. 1 and 5, the closer station 18 is located adjacent and downstream from the feed and cut assembly and generally includes a sewing head 130, such as a Mitsubishi Lockstitch LS2-1280 sewing machine, having a sewing needle 131 (FIG. 5) that engages and sews a lock stitch along the matched leading and trailing edges of the border so as to close the leading and trailing edges of the border and form a completed, substantially continuous loop foundation border for a mattress. It will be understood by those skilled in the art that other types of sewing machines or sewing heads also can be used for closing the leading and trailing edges of the border as known in the art. A pair of closer control eyes or detectors, including a first or leading side eye 132 and a second or trailing side eye 133, are positioned downstream and upstream of the sewing needle 131 of the sewing head 130, respectively, in positions to detect the presence or absence of the side edges of the border as the leading and trailing end edges thereof are being sewn and closed by the closer station. The closer sewing head further includes an undertrimmer (not shown) that operates to cut a thread chain from the border upon the completion of a closing cycle or operation, and closer side puller 134 having a toothed belt 135 that contacts and assists in pulling the border edges through the sewing head 130.

A secondary clamp assembly 136 is mounted in front of the sewing head 130 of the closer station 18 and includes a secondary clamp 137 having opposed clamp blades 138 and 139. The secondary clamp is mounted on a moveable carriage or arm 141 so as to be moveable laterally in the direction of arrows 142 and 142' toward and away from the feed and cut assembly 17 for engaging and transporting the mitered border to the closer station 18. The clamp blades 138 and 139 generally elongated plates, typically formed from a lightweight metal or plastic material, having opposed clamping surfaces or edges 143. The clamp plates are moveable toward and away from each other, between open and closed positions by operation of a pneumatic cylinder 144 mounted on the carriage 141. The cylinder 144 supports and controls the opening and closing movement of the clamp blades, so as to engage and hold the mitered border against its leading and trailing edges, as the trailing edge of the border is cut by the cutting blade 111 (FIG. 1), and thereafter as the border is transported to and moved through the closing station 18 (FIG. 5) for sewing and closing of the leading and trailing edges. The carriage 141 of the secondary clamp 137 generally is mounted on and carried by a toothed belt 146 that extends in a substantially elliptical path around the ends of a carriage frame or support 147, and which is driven by a reversible, variable speed motor 148.

During a closing operation, the secondary clamp will move the mitered border into the closer station until the closer trailing side eye 133 detects the presence of the border material and stops the forward movement of the secondary gripper 137 in the direction of arrow 142'. The closer side puller 134 then typically will be lowered into engagement with the border material adjacent the sewing needle, and thereafter the secondary gripper and closer side puller will control the movement of the border beneath the closer sewing head. Initially, the closer sewing head will sew in a reverse direction until the closer leading side eye 132 detects the absence of the border material (for example, is uncovered). The movement of the border will then be reversed and the closer sewing head will sew in a forward direction until the trailing side eye detects the absence of the border material (i.e., is uncovered) after which the closer sewing head will again sew in a reverse direction for a desired number of stitches or delay to complete the closing operation. For example, the control system can be programmed such the closer sewing head will sew for approximately 1 inch in a reverse direction to complete the closing the leading and trailing edges of the border, although other distances or stitch lengths also can be programmed as desired or necessary.

Upon completion of a closing operation, the secondary gripper cylinder 144 (FIG. 5) will open the clamp blades 138 and 139 to release the completed border. An unloader 155 (FIG. 1), positioned beneath the sewing and head and secondary clamp blades, will then be engaged to assist in the removal of the completed border from the secondary clamp. The unloader 155 generally is a substantially flat pusher plate that is mounted to a pneumatic cylinder or other drive mechanism controlled by the control system of the automated border sewing system. Upon completion of the closing operation, the unloader will be automatically moved forwardly by its cylinder to engage and urge the finished, closed border away from the blades of the secondary clamp. The finished border is then permitted to fall into a collection bin or tray 157 positioned therebelow, as shown in FIGS. 1 and 2.

As indicated in FIG. 5, a labeler 160 generally is mounted adjacent and slightly downstream from the closer sewing head 130. The labeler generally includes an inkjet type printing head 161 connected to an ink supply 162. The printing head 161 applies or prints a label or other desired graphics or text on the completed border following a closing operation. The type of label or other graphics applied by the labeler 160 can be programmed into the control system so that the control system will automatically apply a label or programmed design after the completion of a border forming operation.

In operation of the automatic border sewing system 10 of the present invention, an operator will press "start" on the operator interface 13 (FIG. 1) to begin a border formation operation. The drive rolls 28 and 29 (FIG. 3) of the pre-feed assembly 16 are then engaged and begin to pull border material 11 from the supply 25 until the border pre-feed slack detector 54 detects sufficient slack being formed and signals the control system to disengage the pre-feed assembly. At this point, during the initial startup operation of the system, the primary clamp 101 (FIG. 4B) moves outwardly, whereupon the cutting blade 111 cuts the border material to create a leading edge of a first border to be formed and provides a known start position for feeding of the border material. Thereafter, the drive rolls 63 A/B and 64 A/B of drive assembly 61 of the feed and cut assembly 17 begin to feed the border material, while the encoder (not shown) begins counting the revolutions of its drive roll. Based on the pulse or counts provided by the encoder, the control system monitors the feeding of the border material 11 until a primary clamp distance is reached, after which the drive rollers 63A/B and 64A/B are turned off and the primary clamp engages and holds the leading edge of the border material against the clamp plate 106. The clamp plate and primary clamp are then retracted to an outward position by cylinder 109, after which the drive rolls continue feeding the border material 11 along its path of travel 76.

The feeding of the border material by the drive rollers 63A/B and 64A/B is maintained until the control system determines, based upon the counts or pulses provided by the encoder, that first miter or corner location has been reached. Thereafter, the drive rollers are turned off and a folding plate 77 (FIG. 4B) is moved laterally into engagement with the corner portion 73 of the border material 11. The upper drive rolls 63A/B are then reengaged so as to rotate in a forward direction, while the lower drive rolls 64 A/B are engaged so as to rotate in a reverse direction, which causes the border material that is being urged between the upper and lower drive rollers by the folding plate, to be engaged and begin to be pulled between the drive rolls. At approximately the same time, the lift cylinder 71 is activated by the control system so as to extend and urge the upper drive rollers away from the lower drive rollers to open a gap between the upper and lower guide rollers to facilitate the feeding of the corner portion of the border material therebetween.

The corner portion 73 of the border material is fed between the drive rolls and onto the sewing table 85 of the sewing station 62 until a desired or programmed miter fold distance is reached. Thereafter, the operation of the upper and lower drive rollers is halted, while a clamp plate 87 (FIG. 4A) is lowered into engagement with the border to hold the border against the upper surface 86 of the sewing table 85. The miter sewing head 90 is then activated and begins sewing at an angle along the corner portion of the border material to cut and sew a mitered corner therein. The sewing head is carried by carriage 92 in the direction of arrow 94 for sewing the mitered corner in the corner portion of the border material until sewing detector 95 detects the absence of the border material, i.e., is uncovered. The sewing detector will then send a signal to the control system to activate a stop delay during which the sewing head will continue sewing for a desired number of stitches so as to sew off the corner portion of the border material, after which the sewing head will stop sewing and a chain cutter (not shown) will cut the thread chain from the sewn corner of the border material.

Thereafter, the clamp plate 87 will disengage from the border material and the sewing head will be moved in the direction of arrow 94' back to its rest or initial position. At about the same time, the upper drive rolls will be turned on in a reverse direction, while the lower drive rolls will be turned on in a forward direction so as to begin to pull back the border material therebetween. After a desired amount of border material has been pulled back between the rolls, for example, four to five inches, both sets of drive rollers are turned off and the lift cylinder 71 (FIG. 4B) is again engaged to reopen the gap between the upper and lower feed rollers. The lower drive rolls are further separated by operation of a drive roll cylinder 165 attached thereto so as to open an additional gap between the drive rollers as a tucking plate 96 is extended, whereupon its fingers 97 will engage and force the border downwardly into the opening between the lower drive rollers. Thereafter, the lower drive rolls are retracted back to their closed position, as the tucking plate is retracted by its cylinder 98. The upper and lower drive rolls then are both turned on in their forward direction for further feeding the border material through the feed and cut assembly along its forward path of travel. Initially, the drive rolls are operated at low speed until the mitered corner portion has been fed past the cutting blade, after which the drive rolls are stopped and the lower drive rolls are separated, following which the upper and lower sets of drive rolls are reactivated in high speed for feeding the border material therethrough. The mitering or sewing process for forming a mitered corner in the border, as discussed above, is repeated until all four corners of the border have been cut and sewn.

Once the last mitered corner has been sewn in the border being formed, the drive rollers 63A/B and 64A/B (FIG. 4) of the feed and cut assembly 17 are turned off and stop feeding any further border material. The primary clamp is then moved inwardly by cylinder 109 while the border support roller 126 (FIG. 1) is moved outwardly into engagement with the border. Secondary clamp 137 is then moved under the feed and cut assembly into a clamping position, whereupon its clamp blades 138 and 139 are closed about the border adjacent leading and trailing edges thereof. The border support roller is then disengaged as the cutting blade 111 engages and cuts the trailing edge of the border.

After the border has been separated from the remaining supply of border material, the secondary clamp 137 carries the border into the closer station 18 (FIG. 1). Upon detection of the border by a closer trailing side edge eye 133 (FIG. 5), the further forward movement of the border into the closer station is halted and the closer side puller 134 brought into engagement with the border. Thereafter, the secondary clamp and closer side puller together move the border under the closer sewing head 130 for sewing the leading and trailing edges of the border together. The closer sewing head initially sews in a reverse direction until a closer leading side edge eye 132 is uncovered, after which the closer sewing head will sew in a forward direction until the closer trailing side edge eye is uncovered, following which the closer sewing head generally will again sew in a reverse direction for a desired length or number of stitches, for example, approximately 1 inch, although greater or lesser sewing distances also can be used as desired. Thereafter, the undertrimmer of the closer sewing head will cut the threads from the border to complete the closing sewing operation.

Additionally, the secondary clamp can move the finished border under the printer head 161 of labeler 160 for printing a desired label or graphics along the body of the border. Thereafter, the clamp blades 138 and 139 in the secondary clamp are opened and the unloader plate 155 is extended into engagement with the completed, finished border so as to help urge the border out of the secondary clamp, which is then returned to a wait or rest position by its carriage to await a next border to be closed, while the completed, finished border is allowed to fall or collect in a collection bin or tray 157 positioned therebelow.

The automatic border sewing system further can continue to produce mattress foundation borders of desired sizes or lengths automatically. This enables an operator to monitor and operate multiple machines or systems simultaneously or perform other necessary tasks. Once the end of a roll or supply of border material has been reached, the trailing end of the supply of border material will be detected by end or edge detector 47 (FIG. 3) of the pre-feed assembly 16. The end detector will accordingly signal the control system that the end of the border material has been reached to shut down the automatic border sewing system and provide an alert or warning to the operator that the supply of border material has been exhausted. The operator can then place a new supply of border material on the support or spindle and splice the leading end of this new supply of border material to the trailing end of the previous supply of border material. Thereafter, the splice detector 48 of the pre-feed assembly 16 will detect the presence of such a splice as the splice is passed thereunder. As the splice passes under the roller 49 of the splice detector 48, a sensor or switch 52 of the splice detector signals the control system that a splice has been detected. Given the known position of the splice detector relative to the length of border material between the splice detector and the feed and cut assembly, the control system can determine the location of the splice so that the automatic sewing system thereafter can automatically remove the splice from the border material.

It will be understood by those skilled in the art that while the invention has been discussed above with reference to preferred embodiments, various changes, modifications and additions can be made thereto without departing from the spirit and scope of the invention as set forth in the following claims.

What is claimed is:

1. A method of automatically forming a mattress border, comprising:

(a) providing a workpiece of a desired length for forming the border;

(b) moving the workpiece along a path of travel adjacent a sewing station;

c) feeding a selected portion of the workpiece into the sewing station;

d) forming a mitered corner in the selected portion of the workpiece at the sewing station and removing the selected portion of the workpiece from the mitering station;

(e) repeating steps c–d until four mitered corners are formed in the work piece; and (f) closing the workpiece to form a completed border.

2. The method of claim 1 and wherein providing a workpiece comprises drawing a fabric border material from a supply and measuring the desired length of fabric border material drawn from the supply.

3. The method of claim 2 and further comprising detecting a splice in the border material.

4. The method of claim 1 and further comprising applying a label to the workpiece.

5. The method of claim 1 and wherein applying a label comprises printing on the workpiece.

6. The method of claim 1 and further including marking the workpiece at desired intervals therealong for placement of handles along the workpiece.

7. The method of claim 1 and wherein providing the workpiece comprises engaging and severing an excess length of a fabric border material so as to create a known starting point, and measuring a predetermined amount of the fabric border material drawn from a supply sufficient to form the workpiece of the desired length.

8. The method of claim 7 and wherein engaging and severing an excess length of the fabric border material comprises clamping the fabric border material with a primary clamp, engaging the fabric border material adjacent the primary clamp with a cutter, and cutting a leading edge of the fabric border material.

9. The method of claim 1 and wherein moving the workpiece comprises engaging and holding a leading edge of the workpiece with a first primary clamp and engaging and feeding the work piece along the path of travel with a series of feed rollers.

10. The method of claim 1 and wherein moving a selected portion of the workpiece comprises monitoring the feeding of the workpiece, detecting a mitering location approaching the sewing station, moving a first feed roller in a first direction and a second feed roller in a second, opposite direction so as to draw the selected portion of the workpiece therebetween.

11. The method of claim 1 and wherein closing the workpiece comprises engaging the workpiece with a secondary clamp, transporting the workpiece to a closer station, and sewing a leading edge and a trailing edge of the workpiece together.

12. The method of claim 11 and further comprising cutting the trailing edge of the work piece after the workpiece has been engaged by the secondary clamp.

13. The method of claim 11 and wherein sewing the leading edge and trailing edge of the workpiece comprises sewing the workpiece in a reverse direction until the first side edge of the workpiece is detected and thereafter sewing the workpiece in a forward direction.

14. The method of claim 11 and further comprising applying a label to the workpiece after closing the leading and trailing edges of the workpiece.

15. The method of claim 11 and further comprising disengaging the secondary clamp from the workpiece and engaging the workpiece with an unloading member.

16. The method of claim 1 and wherein forming a mitered corner in the selected portion of the workpiece comprises moving the selected portion of the workpiece into the sewing station until a miter fold distance is reached, engaging and sewing a mitered corner along the selected portion of the workpiece, detecting completion of a sewing cycle, and halting the sewing cycle.

17. An automatic border sewing system, comprising:

a pre-feed assembly for feeding a length of border material to form a border;

a feed and cut assembly that receives, measures and cuts the border from the length of border material, and which includes a drive assembly, a cutting blade, and a sewing station into which a corner portion of the border are fed for forming a mitered corner in the border;

a closer station downstream from the feed and cut assembly, having a closer sewing head for sewing a leading and trailing end of the border and a clamp assembly for holding the border as the leading and trailing ends of the border are sewn; and a control system.

18. The automatic border sewing system of claim 17 and wherein the drive assembly comprises an upper drive roll, a lower drive roll, and a pair of drive motors for driving the upper and lower drive rolls independently.

19. The automatic border system of claim 18 and further comprising a folding plate adjacent the upper and lower drive rolls and movable into engagement with the border material so as to urge the border between the upper and lower drive rolls, and wherein one of the upper and lower drive rolls is moveable so as to create a gap between the upper and lower drive rolls for receiving and moving the corner portion of the border therebetween and into the sewing station.

20. The automatic border sewing system of claim 17, and wherein the control system comprises an operation interface.

21. The automatic border sewing system of claim 17 and wherein the control system comprises a serial bus control system.

22. The automatic border sewing system of claim 17 and wherein the sewing station comprises a sewing head for cutting and sewing mitered corners in the border, and a sewing detector mounted in a position to detect an edge of the border for signaling the control system to control the sewing of the border.

23. The automatic border sewing system of claim 17 and wherein the pre-feed assembly further comprises a splice detector.

24. The automatic border sewing system of claim 23 and wherein the splice detector includes a roller that rolls over the border material and a detector for sending a signal to the control system indicating detection of a splice in the border material being fed.

25. The automatic border sewing system of claim 17 and wherein the pre-feed assembly further comprises an end edge detector for detecting an end of the border material.

26. The automatic border sewing system of claim 17 and wherein the closer station further comprises a labeler for applying a label to the border.

27. The automatic border sewing system of claim 17 and wherein the closer station further includes a leading side edge detector positioned downstream from the closer sewing head and a trailing side edge detector positioned upstream of the closer sewing head.

28. A system for automatically measuring, cutting, closing and forming mitered corners in a mattress border, comprising:

a pre-feed assembly adapted to supply a length of material to form the border;

a drive assembly downstream from the pre-feed assembly for measuring and feeding the desired length of material to the border and for selectively feeding corner portions of the border to a sewing station;

said sewing station including a sewing head adapted to engage and sew mitered corners along the corner portions of the border, and a sewing detector for monitoring a sewing operation;

a closer station downstream from said sewing station for closing leading and trailing ends of the border; and a control system for monitoring and controlling operation of the system.

29. The system of claim 28 and wherein the drive assembly comprises an upper drive roll, a lower drive roll, and a pair of drive motors for driving the upper and lower drive rolls independently.

30. The system of claim 28 and wherein the control system comprises an operation interface.

31. The system of claim 28 wherein the pre-feed assembly further comprises a splice detector.

32. The system of claim 28 and wherein the closer station further comprises a labeler for applying a label to the border.

* * * * *